United States Patent [19]

Kanehara et al.

[11] Patent Number: 4,960,196

[45] Date of Patent: Oct. 2, 1990

[54] AUTOMATIC TOLL COLLECTOR

[75] Inventors: Koichi Kanehara; Kazumi Fukuda, both of Hyogo, Japan

[73] Assignee: Mitsubishi Jukogyo Kabushiki Kaisha, Tokyo, Japan

[21] Appl. No.: 312,836

[22] Filed: Feb. 15, 1989

[30] Foreign Application Priority Data

Feb. 17, 1988 [JP] Japan ..... 63-19442[U]

[51] Int. Cl.[5] ..... G07F 1/04; G07F 9/08

[52] U.S. Cl. ..... 194/215; 194/344; 194/346; 194/352; 194/901; 232/7

[58] Field of Search ..... 194/352, 344, 346, 901, 194/902, 215; 453/32, 34; 232/7, 9, 12, 13, 14, 15, 16

[56] References Cited

U.S. PATENT DOCUMENTS

| | | | |
|---|---|---|---|
| 2,136,891 | 11/1938 | Rockola | 194/352 X |
| 3,930,512 | 1/1976 | Woodland | 453/32 X |
| 4,475,564 | 10/1984 | Koester et al. | 194/346 X |

FOREIGN PATENT DOCUMENTS

| | | |
|---|---|---|
| 769088 | 2/1957 | United Kingdom . |
| 769985 | 3/1957 | United Kingdom . |
| 830919 | 3/1960 | United Kingdom . |
| 1101209 | 1/1968 | United Kingdom . |
| 1304352 | 1/1973 | United Kingdom . |
| 1397558 | 6/1975 | United Kingdom . |

*Primary Examiner*—F. J. Bartuska

*Attorney, Agent, or Firm*—Stanger, Michaelson, Spivak & Wallace

[57] ABSTRACT

An automatic toll collector of a throw-in type is installed in toll roads, parking places and other tollgates so that a driver can pay a toll while the driver sits on a driver's seat. The toll collector includes a large hopper for easily receiving coins thrown by a user, a distinction sensor for distinguishing counterfeit coins and genuine coins from coins thrown in the hopper and identifying kinds of the coins, a counting device for counting coins thrown in the hopper to calculate an amount of the coins when the genuine coins are distinguished by the distinction sensor, a counterfeit coin discharging device for discharging the counterfeit coins to return to the user when the counterfeit coins are distinguished by the distinction sensor, a temporary holding device for temporarily holding the coins thrown in the hopper in a state where the user can visually confirm the coins from a front side of the collector until a procedure of at least a next automobile is finished, and a device for moving down a holding portion of the temporary holding device stepwise to drop the coins held in a lowermost holding portion into a cashbox so that the procedure of the next automobile can be made when an amount of coins counted by the counting device exceeds a set value.

1 Claim, 4 Drawing Sheets

AUTOMATIC TOLL COLLECTOR

FIELD OF THE INVENTION AND RELATED ART STATEMENT

The present invention relates to an automatic toll collector of a throw-in type which is installed in toll roads, parking places and other tollgates so that a driver can pay a toll while the driver sits on a driver's seat.

FIG. 5 shows an inner structure of a conventional automatic toll collector of this type and FIGS. 6(*a*) and (*b*) are a side view and a rear view showing the appearance of the collector of FIG. 5. Referring to FIG. 6(*a*), a hopper 43 for receiving coins is disposed on a front upper portion of a body 42. Coins 30 which are thrown in the hopper 43 are classified in a coin selection hopper 31 and a rotating plate 32 to be transported to a distinction sensor 33 which distinguishes counterfeit coins from genuine coins. A steering solenoid 34 is operated in response to the distinction result so that the counterfeit coins are led through a passage 35 to a discharge box 36 and the genuine coins are led through a passage 37 to a temporary reservoir 38. The genuine coins collected in the temporary reservoir 38 falls in a cashbox 41 through a passage 40 by operation of a soleniod 39 when starting of an automobile is detected.

The counterfeit coins in the discharge box 36 and the genuine coins in the reservoir 38 can be seen externally through a window 44 formed in a rear of the body 42. However no other function is provided.

Although the conventional apparatus described allows the coins in the discharge box 36 to be seen externally through the window, it cannot return a coin such as for example a coin of a different country or a memorial coin or a deformed coin which is not a genuine coin but is important to a user and has been thrown in the toll collector. Such a coin can not be returned to the user since there is no provision for any return means. In order to allow the user to take back the coin, it is necessary to inform an operator of the toll gate and open the body 42. This is very troublesome. Furthermore, since coins of other users are mixed in the discharge box 36, it is difficult to identify the coin and this creates other trouble.

Further, while the genuine coins temporarily collected in the reservoir 38 can be also seen externally, when the automobile is started, the genuine coins fall in the cashbox 41 immediately. Accordingly, there is no way to certify lack of payment of a toll and an automobile has forcedly passed through the toll gate. In addition, the temporary reservoir 38 is structured so that the amount of coins collected in the reservoir 38 can not be confirmed externally. This causes distrust that an indication of a remaining amount or a thrown-in amount of the toll is wrong regardless of mistake or misunderstanding of the thrown-in amount by the user. Accordingly accuracy of the toll collector can not be certified.

OBJECT AND SUMMARY OF THE INVENTION

It is an object of the present invention to provide an automatic toll collector which can automatically return to a user a coin such as, for example, a coin of a different country, a memorial coin and a deformed coin which is thrown therein in error by the user to remove complicatedness and which can confirm an amount of temporarily held genuine coins externally even after an automobile has been started.

In order to achieve the object, the automatic toll collector according to the present invention comprises a large hopper for easily receiving coins thrown by a user, means for distinguishing counterfeit coins and genuine coins from coins thrown in the hopper and identifying kinds of the coins, a device for counting coins thrown in the hopper to calculate an amount of the coins when the genuine coins are distinguished by the distinguishing means, a device for discharging the counterfeit coins to return to the user when the counterfeit coins are distinguished by the distinguishing means, a device for temporarily holding the coins thrown in the hopper in a state where the user can visually confirm the coins from a front side of the collector until a procedure of at least a next automobile is finished, and means for moving down a holding portion of the temporarily holding device stepwise to drop the coins held in a lowermost holding portion into a cashbox so that the procedure of the next automobile can be made when an amount of coins counted by the counting device exceeds a set value.

With the provision of the above means, when the coins thrown in the hopper are not genuine, the coins are automatically discharged externally and accordingly complicatedness for return of the coins is removed. The genuine coins thrown in the collector can be held by the temporarily holding device until the procedure of at least the next automobile has been finished, and an amount of the genuine coins can be confirmed externally. Even if the vehicle has been started with lack of the toll, the lack of the toll can be certified and occurrence of trouble can be prevented.

DETAILED DESCRIPTION OF PREFERRED EMBODIMENTS

Figure 1:
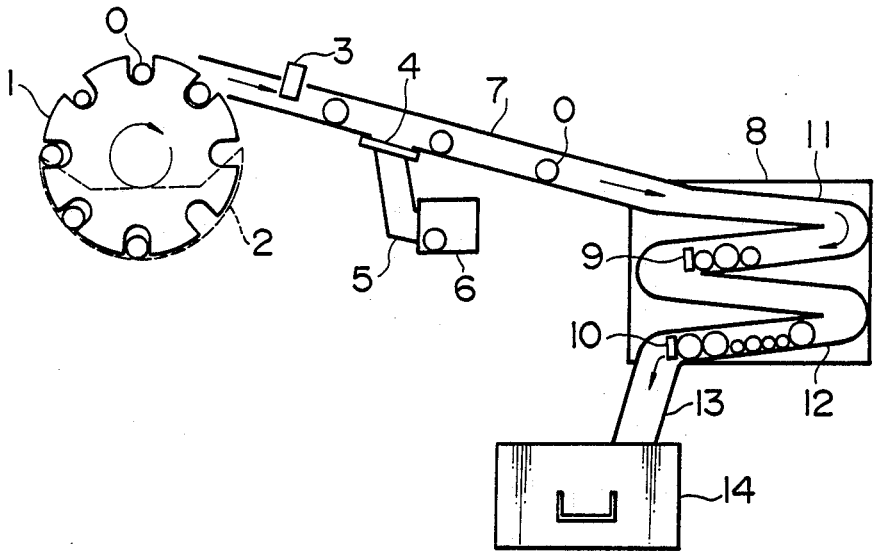
FIG. 1 is a schematic diagram showing the internal structure of an automatic toll collector according to the present invention.
Figures 2A, 2B, 2C:
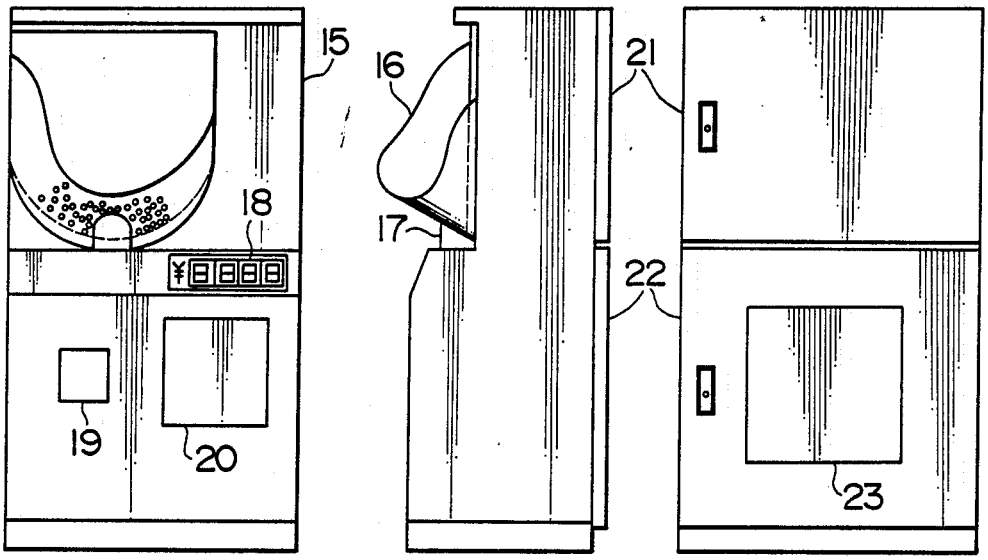
FIGS. 2(*a*), (*b*) and (*c*) are a front view, a side view and a rear view of an automatic toll collector according to the present invention, respectively.

FIGS. 1 to 4 show an embodiment of the present invention, in which FIG. 1 shows the internal structure of an automatic toll collector and FIGS. 2(*a*), (*b*) and (*c*) are a front view, a side view and a rear view showing the appearance of the automatic toll collector, respectively.

Figure 5:
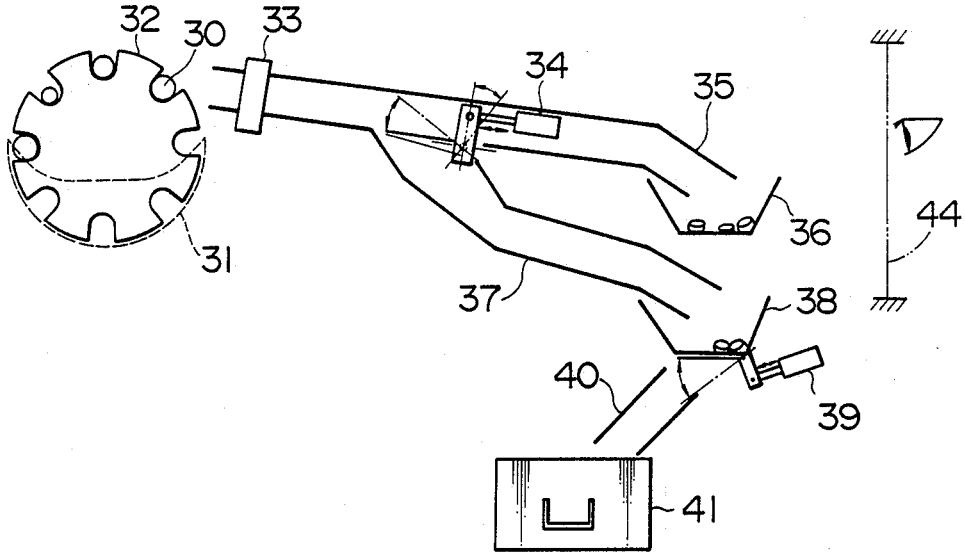
FIG. 5 PRIOR ART
FIG. 5 is a schematic diagram showing an internal structure of a conventional automatic toll collector.
Figure 6A:
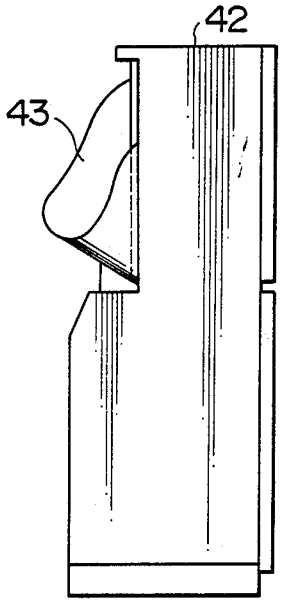
FIG. 6(a) PRIOR ART
FIGS. 6(*a*) and (2) are a side view and a rear view of a conventional automatic toll collector, respectively.
Figure 6B:
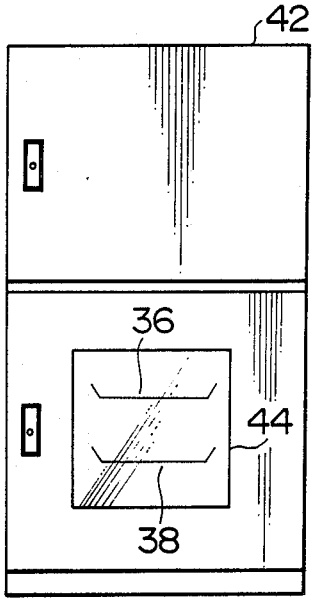
FIG. 6(b) PRIOR ART

FIG. 1, reference numeral 1 denotes a rotating plate, 2 a hopper for selection of coins, and 3 a distinction sensor. The rotating plate 1, the hopper 2 and the sensor 3 are structured in the same manner as those designated by reference numerals 31, 32 and 33 of FIG. 5. Reference numeral 4 denotes a flapper for distinguishing counterfeit coins from genuine coins and to drop the counterfeit coins into a discharge box 6 through a discharge shoot 5. Genuine coins 0 which pass on the flapper 4 without drop are led to a temporary holding device 8 through a passage 7.

The temporary holding device 8 comprises a passage formed with a groove having a gap (width) larger than a thickness of a coin having a maximum thickness in current coins and smaller than a double thickness of current coins having a minimum thickness. The passage meanders with at least two folds from the upper portion toward the lower portion as shown in FIG. 1. Shoulders 9 and 10 each disposed near a lower end of each portion of the meandering passage inclined in the same direction the stop drop of coins temporarily so that a first coin detaining portion 11 for a current vehicle and a second coin detaining portion 12 for a preceding vehicle are formed. Thus, when the shutters 9 and 10 are opened for a predetermined time, the coins detained in the second coin detaining portion 12 fall in a cashbox 14 through a passage 13 and the coins detained in the first coin detaining portion 11 move in the second coin detaining portion 12.

The meandering passage of the temporary holding device 8 has a side portion disposed near a window described later and formed of transparent material so that the amount of coins stored in the meandered passage can be visually confirmed through the window.

In FIG. 2, reference numeral 15 denotes a body of the toll collector, 16 a large hopper for receiving coins, 17 a hopper shoot, 18 a toll indicator, 19 a discharge outlet for counterfeit coins, 20 a window, 21 an upper door, 22 a lower door, and 23 a window for maintenance.

Operation of the toll collector structured above is now described with reference to actual use.

Figure 3:
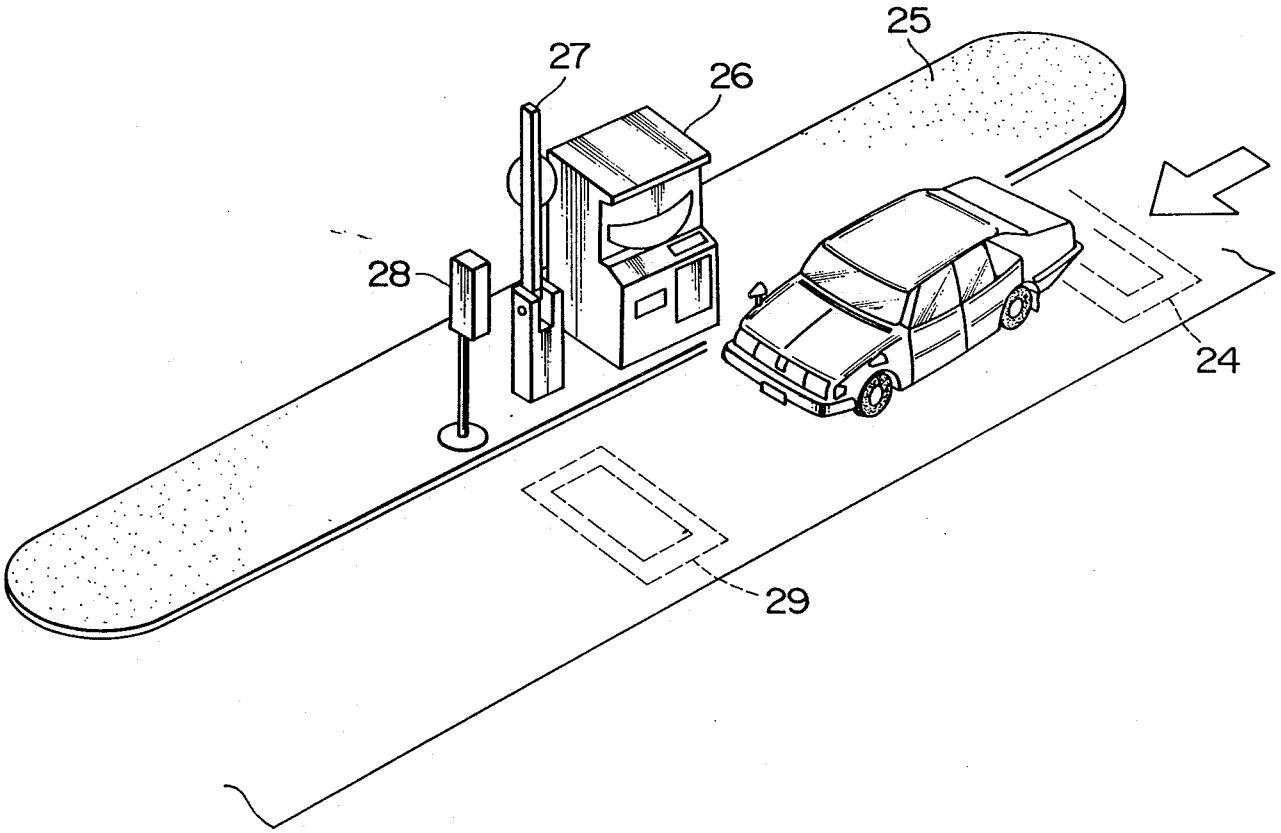
FIG. 3 is a perspective view showing a used state of the automatic toll collector of FIG. 2.
Figure 4:
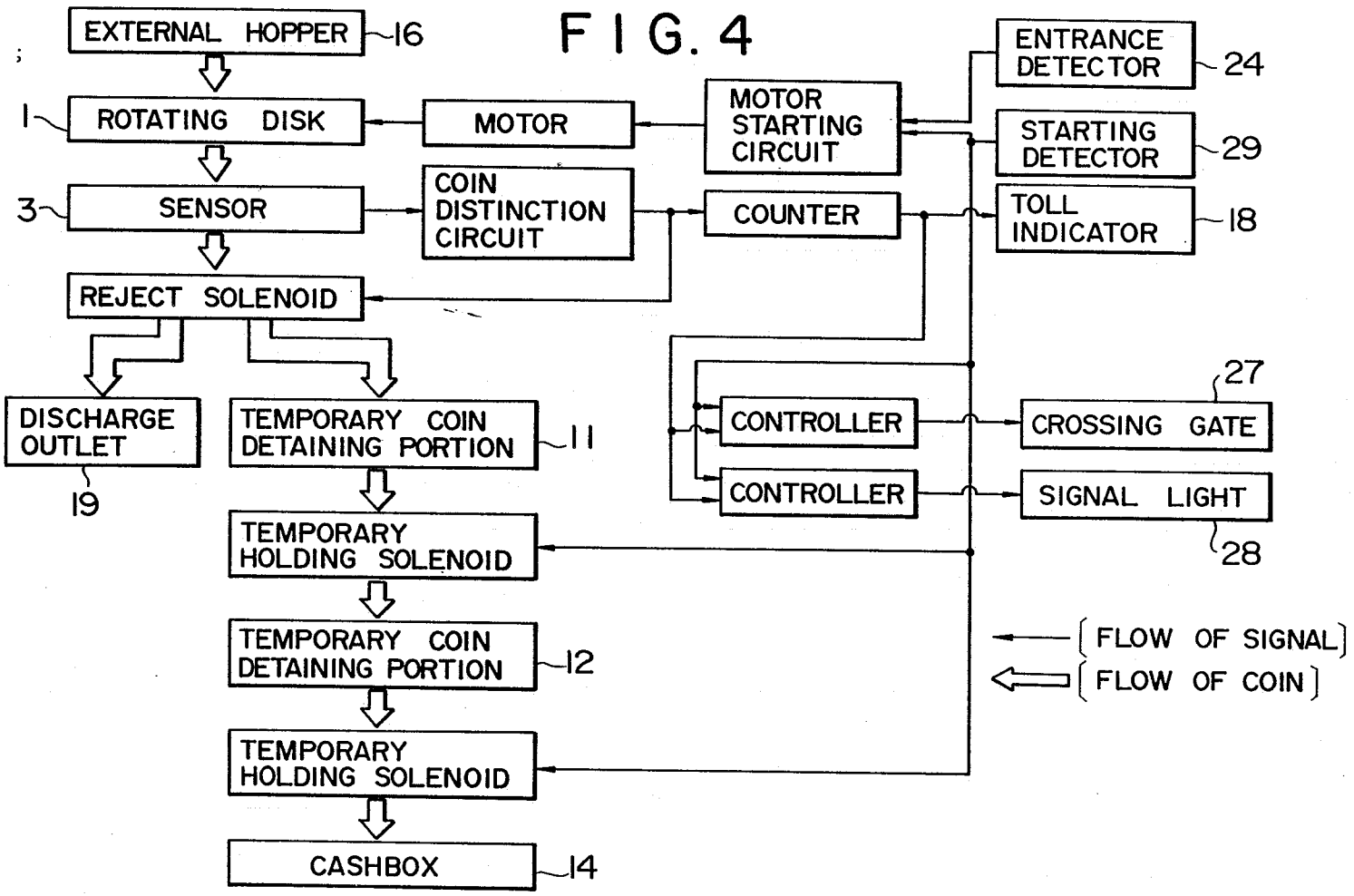
FIG. 4 is a flowchart showing an operation of an automatic toll collector according to the present invention.

FIG. 3 is a perspective view of the toll collector installed in a tollgate to receive coins thrown from the inside of a vehicle. FIG. 4 is a flowchart showing operation of the toll collector shown in FIG. 3.

A vehicle coming in the tollgate is detected by an entrance detector 24 (which may be any existing detector and is not limited to a loop coil type as shown in FIG. 3). When a detection signal of the detector is supplied to an automatic toll collector 26 installed on a tollgate island 25, the toll collector is in a coin receive ready state (in which the rotating disk 1 and a starting motor begin to operate). When an user coming by the side of the toll collector 26 throws coins 0 corresponding to a toll into the hopper 16 from the inside of the vehicle, the coins 0 slide down through the hopper shoot 17 and enter the selection hopper 2. The coins are picked up by the rotating plate 1 one by one to distinguish genuine coins and counterfeit coins from the coins by the distinction sensor 3. As a result of the distinction, when the distinction sensor 3 distinguishes counterfeit coins which can not be received by the toll collector 26, the counterfeit coins 0 pass through the flapper 4 and fall into the discharge shoot 5 and the discharge box 6 so that the coins are returned to the user through the discharge outlet 19 opened in the front of the toll collector 26. Consequently, the coins which can not be received by the toll collector 26 since the coins are slightly deformed in spite of genuine coins or the coins which are thrown in the toll collector 26 by mistake can be returned to the user immediately. On the other hand, when the distinction sensor 3 distinguishes the genuine coins, the toll indicator 18 indicates a value obtained by subtracting an amount of money corresponding to the genuine coins from a set amount, that is, a remaining amount to be paid for the toll. The genuine coins enter the temporary holding device 8 through the passage 7. In the temporary holding device 8, the coins being now thrown in by the user are detained in the first coin detaining portion 11 partitioned by the shutter 9. The detained coins can be confirmed visually through the window 20 disposed at the front of the toll collector 26 and formed of transparent material. With such visual confirmation through the window, the user can confirm the coins thrown by himself and can throw further coins in the toll collector while comparing with the indication of the toll. This can reduce trouble if the user considers the indication or distinction in the toll collector to be wrong in spite of his wrong operation and the user does not believe the toll collector.

Further, the second coin detaining portion 12 for a preceding vehicle of the temporary holding device 8 detains coins for the preceding vehicle. Accordingly, even when the toll collector begins to receive coins thrown by a driver of a next vehicle coming now in the tollgate, there remains evidence that can stifle a complaint from a driver of the preceding vehicle.

On the other hand, when an amount of coins exceeds a set amount, a crossing gate 27 installed on the island 25 is opened and a signal light is turned to blue so that the starting of the vehicle is allowed. When the starting of the vehicle is detected by a starting detector 29, the signal light 28 is turned to red and the crossing gate 27 is closed. At this time, the shutters 9 and 10 of the toll collector 26 are opened for a predetermined time so that the coins in the detaining portion 12 from the preceding vehicle fall into the cashbox 14 while the coins in the detaining portion 11 are moved down and detained in the detaining portion 12. The rotating plate 1 ceases its rotation after the starting of the vehicle or after an elapse of a predetermined time which is determined on the basis of traffic volume. That is, when the traffic volume is heavy, the time is set to short and when the traffic is light, the time is set to long. Thus, a burden on a motor due to its on and off operation can be reduced.

In maintenance of the automatic toll collector 26, the window for maintenance is opened to confirm operation of the rotating plate 1, the selection hopper 2, the distinction sensor 3 and the flapper 4. Further, the upper door 21 is opened to perform maintenance of the control portion and the lower door 22 is opened to perform maintenance of the mechanical portion.

The present invention is not limited to the above embodiment. For example, each time one coin is thrown in the toll collector, the coin may be carried by a belt, or a further temporary holding device may be added so that there can remain evidence that can stifle a complaint from a driver of a further preceding vehicle. Modification of various types can be made without departing from the spirit of the invention.

According to the present invention, since coins which are thrown in the toll collector but are not genuine coins are exhibited outside automatically, complications for return of the coins is removed. Coins thrown in the toll collector can be held in the temporary holding device until the procedure for the next vehicle is finished and its amount can be visually confirmed externally. Accordingly, even if the vehicle has been started with lack of the toll, the lack of the toll can be certified and occurrence of trouble can be prevented. Thus, if a coin of a different country, a memorial coin or a deformed coin is thrown in the toll collector by mistake, the coin can be returned to the user automatically and complications therefrom can be removed. This provides an automatic toll collector in which an amount of genuine coins held temporarily therein can be visually confirmed externally even if the vehicle has been started.

We claimd

1. An automatic toll collector of the throw-in type for installation on toll roads, parking places, and other toll gates so that a driver can pay a toll while sitting in a driver's seat, comprising a large hopper for receiving coins thrown by a user, a distinguishing sensor for distinguishing between counterfeit coins and genuine coins from among coins thrown in the hopper and identifying the kinds of coins, a counting device for counting coins thrown in the hopper to calculate the amount of the coins after genuine coins are distinguished by said distinguishing sensor, a counterfeit coin discharging device for discharging the counterfeit coins to return to the user when the counterfeit coins are distinguished by said distinguishing sensor, a temporary holding device for temporarily holding the coins thrown in the hopper where the user can visually see the coins until new coins have been thrown into the hopper by a succeeding automobile, said holding device having an upper portion and a lower portion each for holding a plurality of coins, a cash box, means for advancing the coins down along the upper portion holding device into the lower portion to be held in the lower portion and to drop the coins held in the lower holding portion into the cash box so that coins received from the next user can be held in the upper portion when the amount of coins counted by said counting device exceeds a set value, characterized in that said holding device comprises a passage formed of transparent material including a groove having a width and having a thickness larger than a maximum thickness of coins currently in use and smaller than double the thickness of the coins of minimum thickness currently in use, said passage meandering with two folds in the upper portion and two folds in the lower portion, said portions having lower ends, said folds each having a terminus and each having a lane inclined in the same direction as the other fold, a pair of shutters each disposed in a lower end of each of the two portions at a terminus of each lane inclined in the same direction to stop the drop of coins temporarily, an upper detaining portion and a lower detaining portion each forming a part of one of said shutters for temporarily detaining coins in said folds until said counting device determines when the amount of coins in the upper detaining portion reaches a predetermined amount and for opening said two shutters so that the coins in the lower detaining portion are dropped in said cash box and coins in the upper detaining portion are moved to said lower detaining portion to be detained therein.

* * * * *